US011820030B2

(12) United States Patent
Emminger

(10) Patent No.: US 11,820,030 B2
(45) Date of Patent: Nov. 21, 2023

(54) CUTTING SET WITH WAVE-SHAPED CUTTING EDGE

(71) Applicant: Wahl GmbH, St. Georgen (DE)

(72) Inventor: Gerd Emminger, Niedereschach (DE)

(73) Assignee: WAHL GMBH, St. Georgen (DE)

( * ) Notice: Subject to any disclaimer, the term of this patent is extended or adjusted under 35 U.S.C. 154(b) by 0 days.

(21) Appl. No.: 17/237,425

(22) Filed: Apr. 22, 2021

(65) Prior Publication Data

US 2021/0331338 A1 Oct. 28, 2021

(30) Foreign Application Priority Data

Apr. 24, 2020 (EP) ..... 20171357

(51) Int. Cl.
*B26B 19/38* (2006.01)
*B26B 19/20* (2006.01)
*B26B 19/12* (2006.01)

(52) U.S. Cl.
CPC ..... *B26B 19/3846* (2013.01); *B26B 19/20* (2013.01); *B26B 19/12* (2013.01)

(58) Field of Classification Search
CPC ..... B26B 19/3846; B26B 19/20; B26B 19/12
See application file for complete search history.

(56) References Cited

U.S. PATENT DOCUMENTS 159,004 A * 1/1875 Wilkins ..... A45D 24/36 132/148
402,727 A * 5/1889 Eisenhuth ..... B26B 19/20 30/201
1,780,276 A * 11/1930 Scheiwer ..... B26B 19/06 30/223
1,791,228 A * 2/1931 Scheiwer ..... B26B 19/06 30/225
1,908,385 A * 5/1933 Wahl ..... B26B 19/20 30/195

(Continued)

FOREIGN PATENT DOCUMENTS

DE 656403 1/1938
DE 102009035232 A1 * 2/2011 ..... B26B 19/3846

(Continued)

OTHER PUBLICATIONS

English translation of DE656483.

(Continued)

*Primary Examiner* — Jonathan G Riley
(74) *Attorney, Agent, or Firm* — Greer, Burns & Crain, Ltd

(57) ABSTRACT

Blade arrangement for a hair clipper comprising
a comb with an anterior edge, which contains tooth elements;
a blade with an anterior cutting edge, which contains tooth elements, wherein the cutting edge at its anterior end is downwardly sloped towards the lower cutting edge, and wherein the blade is configured to be movable relative to the comb;
a connecting device, which connects the comb and the blade relatively movable to each other; and
a pretension element, which preloads the comb and the blade against each other characterized in, that
the cutting edge of the blade have a wave shape, wherein the anterior cutting edge of the blade contains at least three tooth elements and/or the edges of each tooth element have a curved shape according to the wave shape.

18 Claims, 6 Drawing Sheets

(56) References Cited

U.S. PATENT DOCUMENTS

| | | | | |
|---|---|---|---|---|
| 2,174,130 | A | 9/1939 | Looper | |
| 2,274,924 | A * | 3/1942 | Hill | B26B 19/06 30/225 |
| 2,381,046 | A * | 8/1945 | Giorgi | B26B 19/20 30/201 |
| 2,641,833 | A * | 6/1953 | Need | B26B 19/06 30/223 |
| 5,933,964 | A * | 8/1999 | Altamore | B26B 19/06 30/195 |
| 5,964,037 | A | 10/1999 | Clark | |
| 6,427,337 | B1 * | 8/2002 | Burks | B26B 19/063 30/200 |
| D672,924 | S * | 12/2012 | Amice | D30/158 |
| D872,367 | S * | 1/2020 | Yan | D28/54 |
| 2008/0209741 | A1 * | 9/2008 | Chen | B26B 19/3846 30/238 |
| 2009/0119932 | A1 * | 5/2009 | Lau | B26B 19/06 30/355 |
| 2009/0126201 | A1 * | 5/2009 | Melton | B26B 19/3846 30/208 |
| 2012/0192436 | A1 * | 8/2012 | Toy | B26B 19/386 30/216 |
| 2014/0115901 | A1 * | 5/2014 | Liao | B26B 19/06 30/208 |
| 2016/0075039 | A1 * | 3/2016 | Werner | B26B 19/3846 30/201 |
| 2018/0056533 | A1 * | 3/2018 | Johnson | B26B 19/3846 |
| 2018/0297226 | A1 * | 10/2018 | Kim | B26B 21/56 |

FOREIGN PATENT DOCUMENTS

| | | | | |
|---|---|---|---|---|
| EP | 2583798 | A1 * | 4/2013 | B26B 19/3846 |
| EP | 3117972 | A1 * | 1/2017 | B26B 19/042 |
| GB | 2002279 | A | 2/1979 | |
| GB | 2347377 | | 9/2000 | |

OTHER PUBLICATIONS

European Search Report for EP28171357.S dated Oct. 2, 13828.
International Search Report and Written Opinion received for PCT/EP2021/060842, dated Jul. 19, 2021.

* cited by examiner

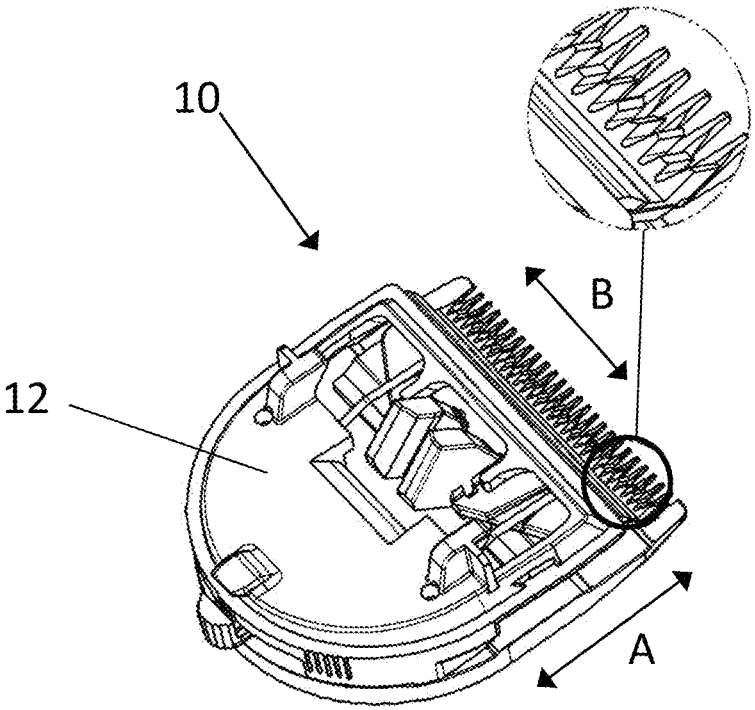
Fig. 2
Fig. 3a
Fig. 3b
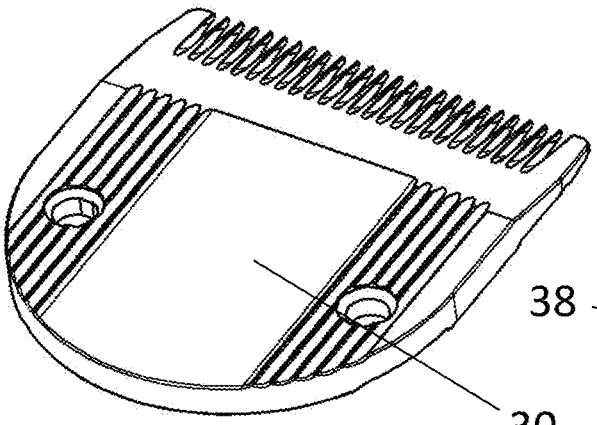
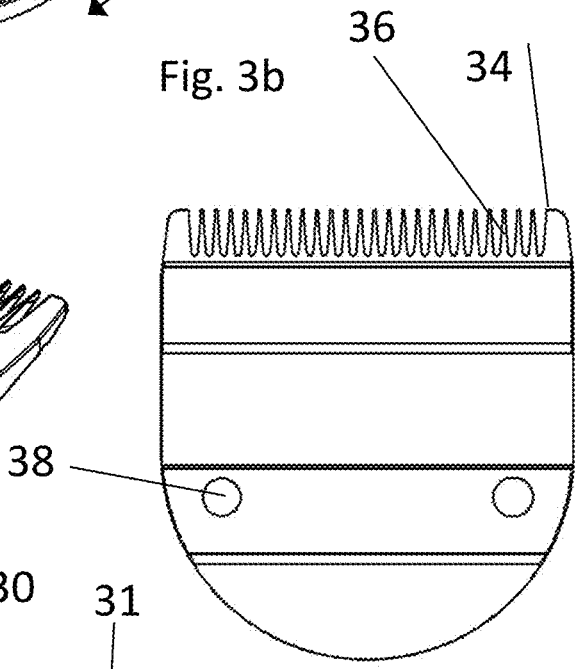
Fig. 3c
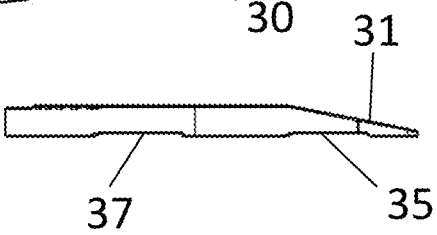

CUTTING SET WITH WAVE-SHAPED CUTTING EDGE

FIELD OF THE INVENTION

The invention relates to a cutting set for a hair clipper on which a cutting edge is wave-shaped.

BACKGROUND

Multiple hair clippers with different blade sets are known from the art. For example, U.S. Pat. No. 7,841,091 B2 discloses a blade set for a hair clipper comprising at least one stationary blade with multiple stationary blade teeth and at least one movable blade with multiple stationary blade teeth, which are configured to laterally move back and forth relative to the at least one stationary blade for cutting hairs. The movable blade contains a set of long teeth, which are configured to cut hairs over the width of the movable blade, and a set of short teeth, which are configured to cut hairs over the width of the movable blade, if a feed speed of the hair clipper exceeds a specific speed.

U.S. Pat. No. 5,933,964 discloses a clipper for cutting hair strands including a blade set which has a stationary blade having a plurality of stationary blade teeth arranged a row so that hair strands enter between adjacent stationary teeth as the blade set moves through the hair strands. The stationary blade teeth have angled side cutting edges and tips, and the side cutting edges of adjacent teeth form roots where they intersect. A moving blade has a plurality of moving blade teeth which are also arranged in a row. The moving blade teeth complement the stationary blade teeth and pass across the stationary blade teeth in use to cut some of the hair strands. The moving blade teeth are relatively short, and preferably have tips which are flat. The moving blade teeth are separated by blade-like edge surfaces which are oriented in the direction of movement of the moving blade and are capable of cutting some of the hair strands which enter between the stationary blade teeth. The knife-like blade edges form a first line which is between a second line formed by the stationary blade teeth roots and a third line formed by the stationary blade teeth tips.

With these hair dippers a focus is on the cutting of hairs each with the same length. Thus, with such hair clippers, the cutting of a transition is difficult because minor cutting failures in the transition immediately stand out.

SUMMARY OF THE INVENTION

The object of the present invention is to provide a blade arrangement, which simplifies the cutting of transitions in such a way that even non-professional users can create a good-looking transition.

The object is solved by a blade arrangement according to claim 1. The dependent claims contain further developments of the invention.

A blade arrangement for a hair clipper according to the present invention comprises a comb with an anterior edge, which is configured with tooth elements; a blade with an anterior cutting edge, which is configured with tooth elements, wherein the cutting edge is downwardly sloped at its anterior end towards the lower cutting edge, and wherein the blade is configured to be movable relative to the comb; a connecting device, which connects the comb and the blade movably relative to each other; and a pretension element, which preloads the comb and the blade towards one another wherein the cutting edge of the blade is construed in a wave shape, wherein the anterior cutting edge of the blade comprises at least three tooth elements of different lengths and/or the edges of the individual tooth elements are curved shaped corresponding to the wave shape. Via the tooth elements of different lengths and by the curved edges of the tooth elements, the hairs are cut with a slightly different length, which improves the look of the cut within the transition significantly, without special training.

Preferably, one wave extends across at least four tooth elements from one highest point to another highest point, further preferred across five or six and/or across maximum fifteen tooth elements, particularly preferred across thirteen or ten. In particular, the height from wave tip to wave valley is between 1 mm and 4 mm, preferably maximum 3 mm, more preferably maximum 2 mm. The wave tip is the point of the wave that is furthest forward. The wave valley is the point of the wave that is furthest backward.

Preferably, the wave shape is configured to be uniform, whereby a more uniform cutting of individual different lengths of hair can be achieved.

The outermost lateral tooth elements can be configured as a wave tip. Thus, a uniform and especially symmetrical blade arrangement can be established, which simplifies the production.

In particular, the cutting edges, which are positioned closer to the front are thinner than the cutting edges that are positioned further back.

Further, the front cutting edge of the upper blade can comprise at least four tooth elements of different lengths, preferably five or six, but maximum ten.

Preferably, the tooth elements are arranged according to their length in ascending and descending order. Thus, the look of the cutting within the transition becomes more uniform and better looking.

DESCRIPTION OF THE FIGURES

FIG. 2 displays an isometric view of the mounting face of the blade arrangement of FIG. 1 in the mounted state with an enlarged view of the tooth elements;

FIG. 3*a* displays an isometric view of the upper side of the comb;

FIG. 3*b* displays a view of the lower side of the comb;

FIG. 3*c* displays a side view of the comb of FIG. 3*a;*

DETAILED DESCRIPTION

Figure 4A:
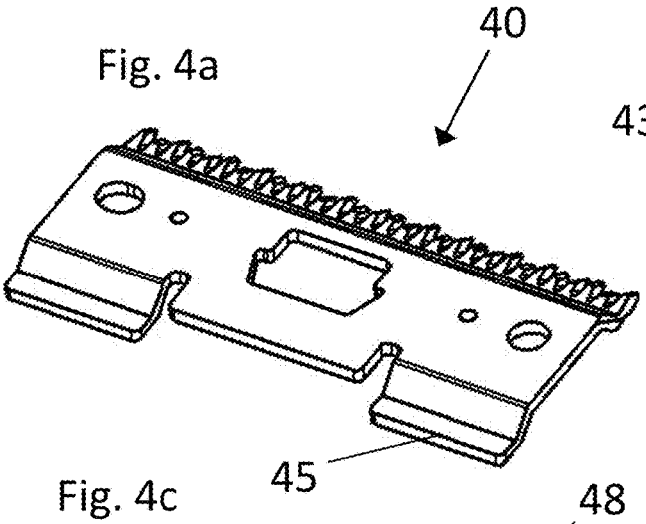
FIG. 4*a* displays an isometric view of the lower side of a first embodiment of the blade.
Figure 4B:
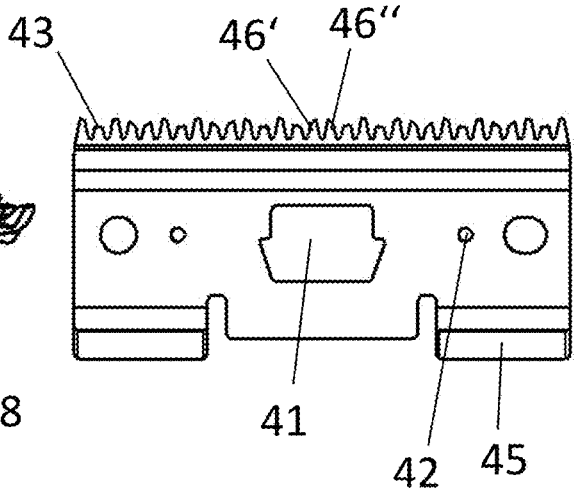
FIG. 4*b* displays a frontal view of the blade displayed in FIG. 4*a* with displayed wave line for the cutting edges.
Figure 4C:
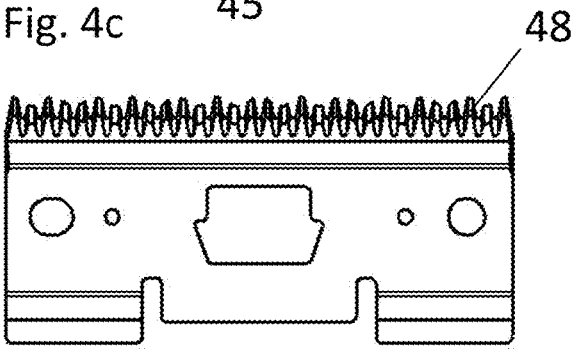
FIG. 4*c* displays a view of the lower side of the blade of FIG. 4*a;*

In the following, the direction "frontal" indicates a direction of the tooth elements (e.g. in FIG. 4*b* on the top side) and "rear" indicates the opposite direction (in FIG. 4*b* on the lower side).

Figure 1:
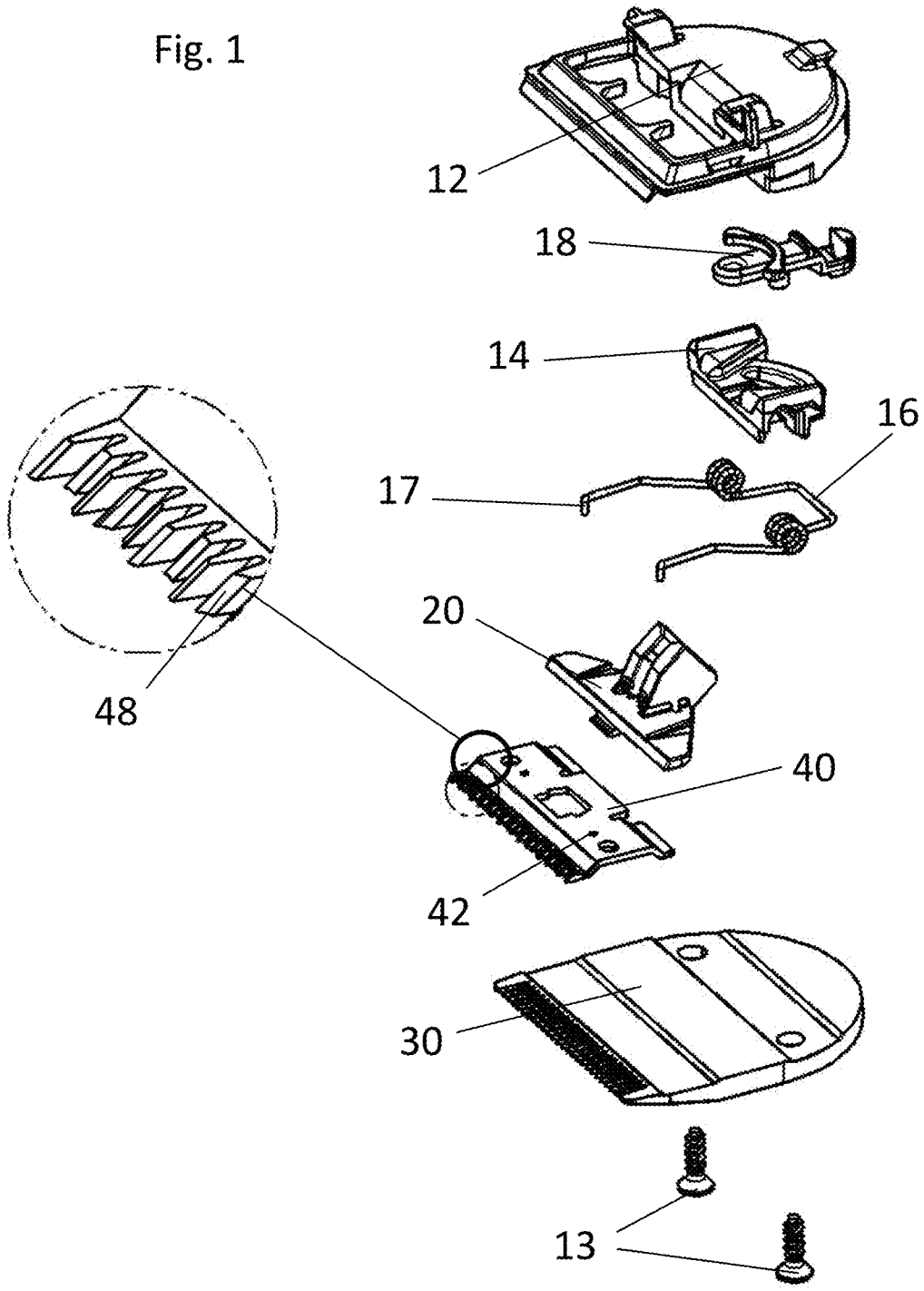
FIG. 1 displays an explosion view of a blade arrangement with an enlarged view of the tooth elements.

FIG. 1 displays an explosion view of the components of a blade arrangement 10 according to the present invention. In FIG. 2, the blade arrangement is displayed in the mounted state. The upper side of the FIGS. 1 and 2 is placed on the handle and attached to a drive, which generates an oscillating movement. The motor for the drive is placed in the handle, as it is common for hair dippers.

A blade arrangement 10 comprises a comb 30, a blade 40, 50, 60, 70, a pretension element 16, which is indicated as spring element 16, and a connection device. The connection device serves to connect the comb 30 and the upper blade 40, 50, 60, 70 and comprises multiple components, whose functions and number can vary. In the displayed embodiment, the connection device comprises a retaining means 12, which is attached to the comb 30 with fixation means 13 and which is placed on the handle of the hair clipper and attached thereto e.g. with a click mechanism. Then, the retaining means 12 also retains the other components of the connection device on the comb 30. Further, the connection device comprises a slide 14, which is connected to the blade 40, 50, 60, 70 and which enables the forward and backward shoving of the blade 40, 50, 60, 70 to set cutting properties (see arrow A in FIG. 2), an actuating element 18, by which the slide 14 is actuated, a spring element 16, which is fixed in a bore 42 of the blade by means of hook-shaped ends 17 and which presses the blade against the comb 30, and a transmission element 20, which transmits the oscillating movement of the drive to the blade 40, 50, 60, 70. In particular, the oscillation takes place in a lateral direction (see arrow B in FIG. 2). The transmission element 20 can be firmly connected to the blade 40, 50, 60, 70.

In FIG. 2, the blade arrangement 10 is displayed in a mounted state, wherein all components of the blade arrangement 10 are installed. In FIG. 1 and FIG. 2, the embodiment of the blade 40 of FIG. 4 is displayed. This is to be understood to be just exemplarily and the described blade arrangement can be used with any blade.

In FIG. 3, the comb 30 is displayed. FIG. 3*a* is a view of the upper side of the comb 30, wherein the blade arrangement 10 is attached to a handle of the hair clipper. The comb 30 comprises a front edge 34, which comprises tooth elements 36. Further, the comb 30 comprises two bores 38, to which the connection device is fixed with fixation means 13. The tooth elements 36 are preferably tapered, whereby the lower side (see FIG. 3*b*), to which the blade 40, 50, 60, 70 abuts, is shaped flatly so as to not impair the cut. This means that the inclination 31 is present at the upper side and can preferably also begin already before the tooth elements.

FIG. 3*c* is a side view of the comb 30. The bores 38 are positioned in recesses 37. Further, a recess 35 is also positioned in front of the tooth elements 36. In these recesses, the blades 40, 50, 60, 70 are inserted in such a way that they are movable forwardly and backwardly by the actuating element and laterally by the drive.

In FIGS. 4 to 7, different embodiments of blade arrangements are displayed. The general structure of the blades 40, 50, 60, 70 is the same. Thus, the following description applies for all blades 50, 60, 70. In FIGS. 4*a*, 5*a*, 6*a* and 7*a* an isometric view of the lower side of the blades 40, 50, 60, 70 is displayed. FIGS. 4*b*, 5*b*, 6*b* and 7*b* are views of the upper side of the blades 50, 50, 60, 70, which abut the comb 30 and FIGS. 4*c*, 5*c*, 6*c* and 7*c* are views of the lower side of the blades 40, 50, 60, 70. In the blade 40, 50, 60, 70, a fixation recess 41, 51, 61, 71 for fixing the transmission element 20 is positioned. On both sides of the fixation recess 41, 51, 61, 71, the bores 42, 52, 62, 72 are configured for the spring element 16.

Figure 4D:
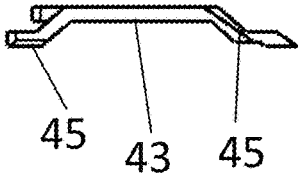
FIG. 4*d* displays a side view of the blade of FIG. 4*a;*
Figure 4E:
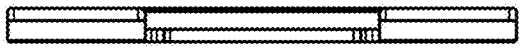
FIG. 4*e* displays a rear view of the blade of FIG. 4*a;*
Figure 4F:
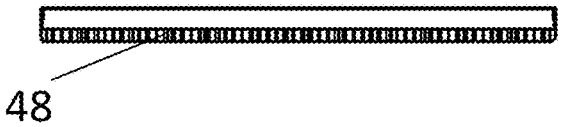
FIG. 4*f* displays a front view of the tooth elements of the blade displayed in FIG. 4*a;*
Figure 5A:
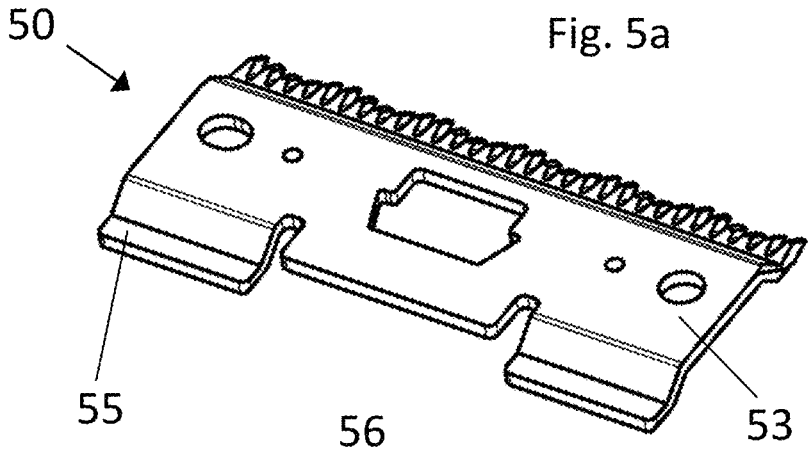
FIG. 5*a* displays an isometric view of the lower side of a second embodiment of the blade.
Figure 5B:
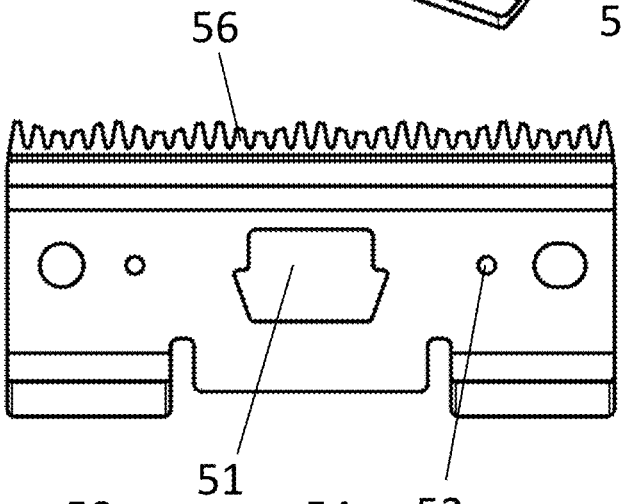
FIG. 5*b* displays a view of the upper side of the blade of FIG. 5*a;*
Figure 5C:
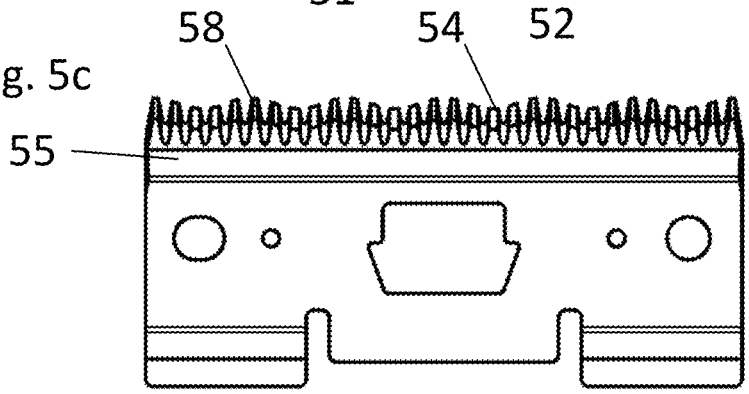
FIG. 5*c* displays a view of the lower side of the blade of FIG. 5*a;*
Figure 6A:
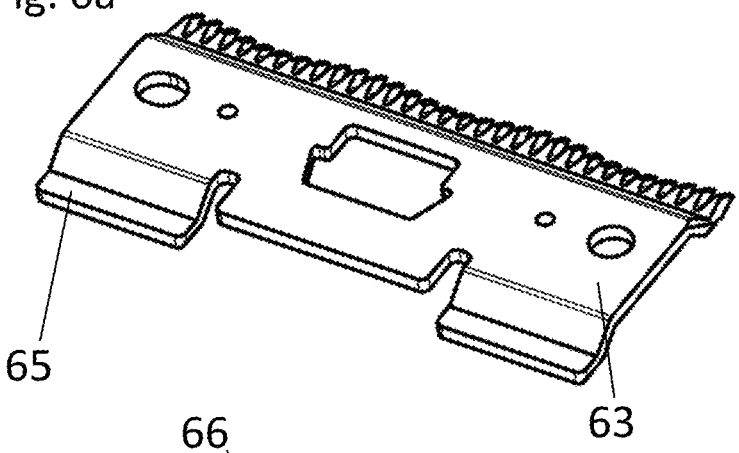
FIG. 6*a* displays an isometric view of the lower side of a third embodiment of the blade.
Figure 6B:
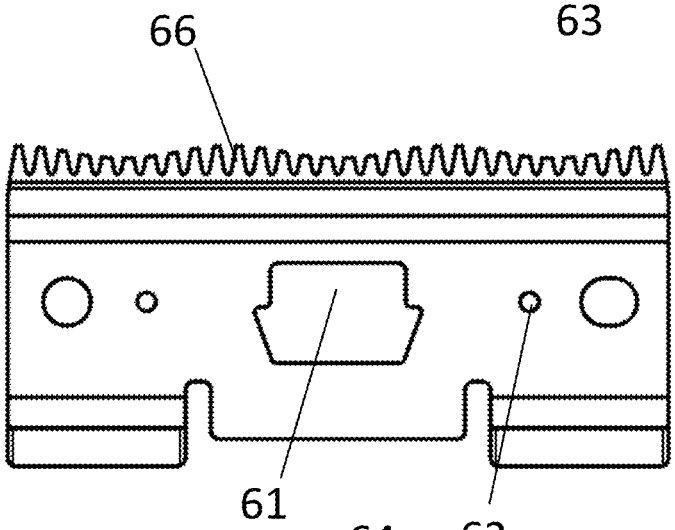
FIG. 6*b* displays a view of the upper side of the blade of FIG. 6*a;*
Figure 6C:
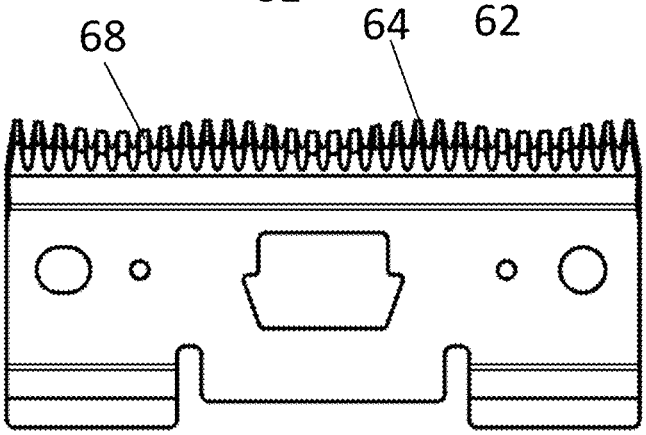
FIG. 6*c* displays a view of the lower side of the blade of FIG. 6*a;*
Figure 7A:
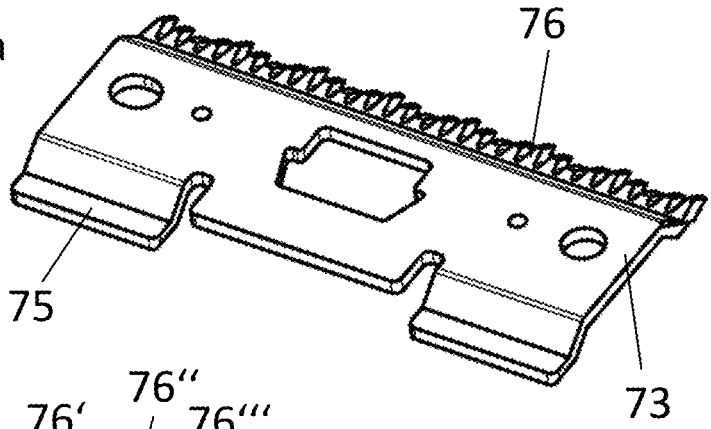
FIG. 7*a* displays an isometric view of the lower side of a fourth embodiment of the blade.
Figure 7B:
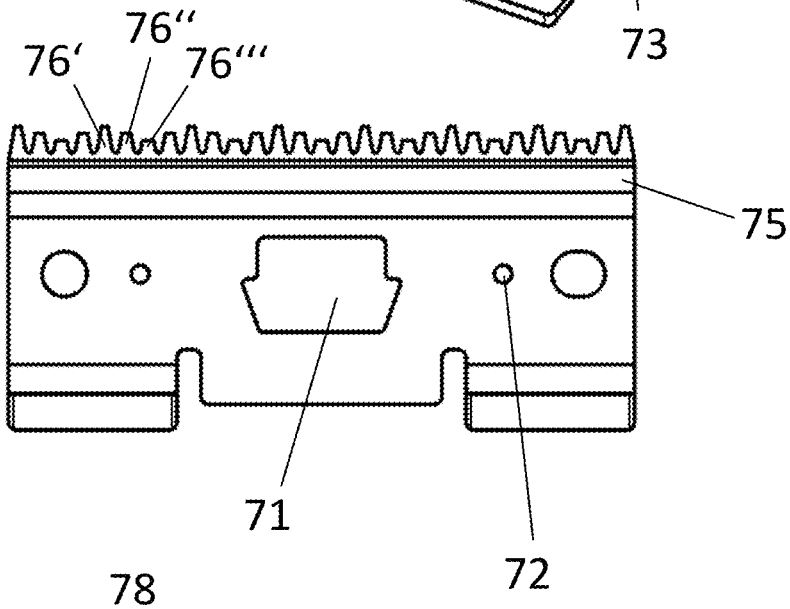
FIG. 7*b* displays a view of the upper side of the blade of FIG. 7*a;*
Figure 7C:
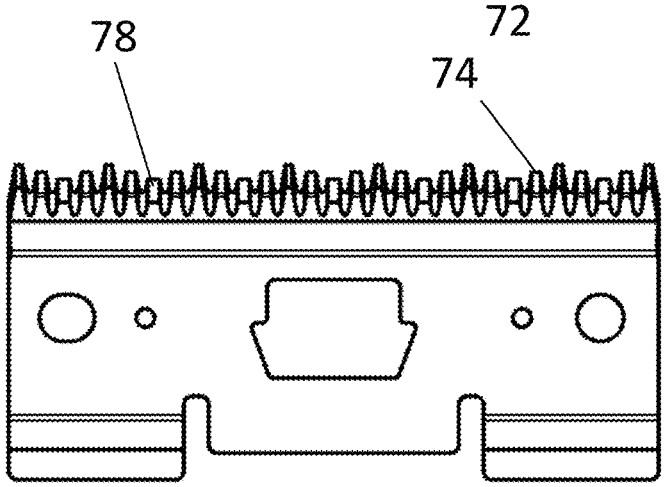
FIG. 7*c* displays a view of the lower side of the blade of FIG. 7*a.*

FIG. 4*d* shows a side view of the blade 40. From the side, it can be seen that the blade 40 has two bearing pedestals 45, which are received in the recesses 35, 37 in the assembled state. The pedestals 45 and the recesses 35, 37 are configured in such a way as to ensure forward/rearward movement of the blade 40 by the actuating element 18. The connecting part 43 the bridge so to speak, connects the pedestals of the blade 40 to each other. FIG. 4*e* is a rear view of the blade 40 and 4*f* is a front view showing the cutting edges of the tooth elements 46. These views are not shown in the embodiments shown in FIGS. 5, 6 and 7. However, these blades 50, 60, 70 are formed accordingly.

The tooth elements 46, 56, 66, 76 are positioned at the frontal edge 44, 54, 64, 74 of the blade 40. The tooth elements 46, 56, 66, 76 are configured in a wave shape. This means that the extension towards the front (on the top side in FIG. 4*b*) of the individual tooth elements 46 is in particular fit to a uniform wave shape. Thereby, the tooth elements 46, 56, 66, 76 have different lengths towards the front, so that there are at least three different lengths of tooth elements 46, 56, 66, 76 (short, medium-sized, long) and a wave reaches from one longest tooth element 46, 56, 66, 76 to another longest tooth element 46, 56, 66, 76. The outward tooth elements 46, 56, 66, 76 are preferably also the largest tooth elements 46, 56, 66, 76, so that the wave always ends at a maximum. Further, it is not necessary to place a tooth element 46, 56, 66, 76 at every maximum of a wave line. The tooth elements 46, 56, 66, 76 comprise cutting edges 48, 58, 68, 78 at their frontal edges, which are inclined at their lower side (the side which is directed away from the comb 30). This is shown from the side in FIG. 4*d*. An inclination of the cutting edges 48, 58, 68, 78 is also displayed in the frontal views of FIGS. 4*c*, 5*c*, 6*c* and 7*c*. The wave shapes are preferably uniform (this means always the same repetitively) and more preferably also formed symmetrical to a line, which is vertical to the maximum of the wave.

In the embodiment of FIG. 4, not only the course of the tooth elements 46 is adapted to this wave but also the geometry of the cutting edges 48 of the individual tooth elements 46 whereby these cutting edges 48 are curvedly formed according to the wave (see the magnification in FIGS. 1 and 2). In the embodiment of FIG. 4, each wave extends across three or four tooth elements 46 and thus is a "short wave". Because of the adjustment according to the wave, there are at least three tooth elements 46 with different lengths although the specific configuration of the tooth elements 46 can lead to a greater variety. For example, tooth element 46' has the same length as tooth element 46", but a different curvature. In FIG. 4*b*, a wave is displayed, which abuts the cutting edges 48 of the tooth elements 46. It can be seen in which way the cutting edges 48 are configured according to the wave line. Here, the "short wave" is displayed but the cutting edges of the "medium-sized wave" and "long wave", which are described in the following, are configured with corresponding wave lines.

In FIG. 5, a second embodiment of the tooth elements is displayed. In general, the configuration of the blade 50 is the same as in FIG. 4, only in this case, the wave shape exhibits a longer wave, which means that one wave extends across five, six or seven tooth elements 56 and is therefore a "medium-sized wave". Also in this embodiment, the cutting edges 56 are configured with a curved shape according to the wave line.

In FIG. 6, a third embodiment of the tooth elements is displayed. Also in this case, the configuration of the blade 60 is the same as in the first embodiment, which is displayed in FIG. 4. Compared to the "medium-sized wave" of FIG. 5, here the shape of the wave exhibits a longer wave. This means that here, the wave contains ten, eleven or even more tooth elements 66. This shape of the wave is called a "long wave". Also in this embodiment, the cutting edges 58 are configured with a curved shape according to the wave line.

In FIG. 7, a further embodiment is displayed. Analogous to the previous embodiments, the configuration of the blade 70 is also the same as in the first embodiment, which is displayed in FIG. 4. In this case however, the cutting edges 78 of the tooth elements 76 are not curved but the shape of the wave is placed through the center of the cutting edges 78. Therefore, there are tooth elements with a cutting edge configured to have different lengths, which are not curved but configured to be straight. With these tooth elements 76, a wave line is recreated wherein two adjacent waves always "share" a maximum. What is displayed is a preferred embodiment of the blade 70, wherein one wave always has five tooth elements. This means that the wave line starts with a long tooth element 76', followed by a medium-sized tooth element 76", a short tooth element 76''' and then a medium-sized tooth element 76" again. The closing long tooth element 76' is also the starting point for the adjacent wave. This embodiment can also be applied to longer wave shapes by adding further tooth elements 76 with different lengths (e.g. a tooth element, which is longer as the medium-sized tooth element 76" but shorter than the long tooth element 76').

REFERENCE SIGN LIST

Blade arrangement 10
Retaining means 12
Fixation means 13
Slide 14
Pretension element 16
Hook-shaped ends 17
Actuating element 18
Transmission element 20
Comb 30
Inclination 31
Edge 34
Recess 35
Tooth element comb 36
Recess 37
Bore comb 38
Blade 40, 50, 60, 70
Fixation recess 41, 51, 61, 71
Bore 42, 52, 62, 72
Bridge 43, 53, 63, 73
Edge 44, 54, 64, 74
Pedestal 45, 55, 65, 75
Tooth element blade 46, 56, 66, 76
Tooth element 46'
Tooth element 46"
Cutting edge tooth element 48, 58, 68, 78
Long tooth element 76'
Medium-sized tooth element 76"
Short tooth element 76'''

What is claimed is:

1. A blade arrangement for a hair clipper, comprising:

a comb with an anterior edge, which is configured with comb tooth elements;

a moving blade with an anterior cutting edge, which is configured with moving blade tooth elements extending in a forward-backward direction, wherein said anterior cutting edge is downwardly sloped at its anterior end towards a lower cutting edge, and wherein the moving blade is configured to be movable relative to the comb;

a connecting device, which connects the comb and the blade movably relative to each other; and a pretension element, which preloads the comb and the blade towards one another, wherein said anterior cutting edge of the moving blade is construed in a wave shape extending in a direction lateral to the forward-backward direction of said moving blade tooth elements and configured to have a wave tip and a wave valley, the edges of the individual moving blade tooth elements are curved in said lateral direction so that said edges define the wave shape, wherein said moving blade comprises at least three moving blade tooth elements with different lengths, wherein each wave of said wave shape extends at least across four moving blade tooth elements, wherein each wave of said wave shape extends from one longest moving blade tooth element to another longest moving blade tooth element, and wherein said moving blade comprises at least two moving blade tooth elements with different curvature in said lateral direction according to said wave shape.

2. The blade arrangement of claim 1, wherein the anterior cutting edge of the blade comprises at least four moving blade tooth elements of different lengths, wherein each wave of said wave shape extends at least across five moving blade tooth elements.

3. The blade arrangement of claim 1, wherein the height from the wave tip to the wave valley is between 1 mm and 4 mm.

4. The blade arrangement of claim 1, wherein a wave line is configured to be uniform.

5. The blade arrangement of claim 1, wherein the outermost lateral moving blade tooth elements are longer than the adjacent moving blade tooth elements.

6. The blade arrangement of claim 1, wherein the cutting edges of the moving blade tooth elements, which are arranged closer to the front are thinner than those arranged further at the back.

7. The blade arrangement of claim 1, wherein the blade contains at least four moving blade tooth elements of different lengths, wherein each wave of said wave shape extends at least across five moving blade tooth elements.

8. The blade arrangement of claim 1, wherein the moving blade tooth elements are arranged according to their length in ascending and descending order.

9. A blade arrangement for a hair clipper, comprising:

a comb with an anterior edge, which is configured with comb tooth elements;

a moving blade with an anterior cutting edge, which is configured with moving blade tooth elements extending in a forward-backward direction, wherein said anterior cutting edge is downwardly sloped at its anterior end towards a lower cutting edge, and wherein the moving blade is configured to be movable relative to the comb;

said anterior cutting edge of the moving blade is construed in a wave shape extending in a direction lateral to the forward-backward direction of said moving blade tooth elements and configured to have a wave tip and a wave valley, the edges of the individual moving blade tooth elements are curved in said lateral direction so that said edges define the wave shape, wherein said moving blade comprises at least three moving blade tooth elements with different lengths, wherein each wave of said wave shape extends at least across four moving blade tooth elements, wherein each wave of said wave shape extends from one longest moving blade tooth element to another longest moving blade tooth element, and wherein said moving blade comprises at least two moving blade tooth elements with different curvature in said lateral direction according to said wave shape.

10. The blade arrangement of claim 9, wherein the anterior cutting edge of the blade comprises at least four moving blade tooth elements of different lengths, wherein each wave of said wave shape extends at least across five moving blade tooth elements.

11. The blade arrangement of claim 9, wherein the height from the wave tip to the wave valley is between 1 mm and 4 mm.

12. The blade arrangement of claim 9, wherein a wave line is configured to be uniform.

13. The blade arrangement of claim 9, wherein the outermost lateral moving blade tooth elements are longer than the adjacent moving blade tooth elements.

14. The blade arrangement of claim 9, wherein the cutting edges of the moving blade tooth elements, which are arranged closer to the front are thinner than those arranged further at the back.

15. The blade arrangement of claim 9, wherein the blade contains at least four moving blade tooth elements of different lengths, wherein each wave of said wave shape extends at least across five moving blade tooth elements.

16. The blade arrangement of claim 9, wherein the moving blade tooth elements are arranged according to their length in ascending and descending order.

17. A blade arrangement for a hair clipper, comprising:

a comb with an anterior edge, which is configured with comb tooth elements;

a moving blade with an anterior cutting edge, which is configured with moving blade tooth elements extending in a forward-backward direction, wherein said anterior cutting edge is downwardly sloped at its anterior end towards a lower cutting edge, and wherein the moving blade is configured to be movable relative to the comb;

a connecting device, which connects the comb and the blade movably relative to each other; and a pretension element, which preloads the comb and the blade towards one another, wherein said anterior cutting edge of the moving blade is construed in a wave shape extending in a direction lateral to the forward-backward direction of said moving blade tooth elements and configured to have a wave tip and a wave valley, the edges of the individual moving blade tooth elements are inclined in said lateral direction so that said edges define the wave shape, wherein said moving blade comprises at least three moving blade tooth elements with different lengths, wherein each wave of said wave shape extends at least across four moving blade tooth elements, wherein each wave of said wave shape extends from one longest moving blade tooth element to another longest moving blade tooth element, and wherein said moving blade comprises at least two moving blade tooth elements with different inclination in said lateral direction according to said wave shape.

18. A blade arrangement for a hair clipper, comprising:

a comb with an anterior edge, which is configured with comb tooth elements;

a moving blade with an anterior cutting edge, which is configured with moving blade tooth elements extending in a forward-backward direction, wherein said anterior cutting edge is downwardly sloped at its anterior end towards a lower cutting edge, and wherein the moving blade is configured to be movable relative to the comb;

said anterior cutting edge of the moving blade is construed in a wave shape extending in a direction lateral to the forward-backward direction of said moving blade tooth elements and configured to have a wave tip and a wave valley, the edges of the individual moving blade tooth elements are inclined in said lateral direction so that said edges define the wave shape, wherein said moving blade comprises at least three moving blade tooth elements with different lengths, wherein each wave of said wave shape extends at least across four moving blade tooth elements, wherein each wave of said wave shape extends from one longest moving blade tooth element to another longest moving blade tooth element, and wherein said moving blade comprises at least two moving blade tooth elements with different inclination in said lateral direction according to said wave shape.

* * * * *